US007736057B2

(12) United States Patent
VanBost

(10) Patent No.: US 7,736,057 B2
(45) Date of Patent: Jun. 15, 2010

(54) LEAF BAG FUNNEL

(75) Inventor: David VanBost, Riverside, RI (US)

(73) Assignee: Leaf Bag Funnel, LLC, Riverside, RI (US)

( * ) Notice: Subject to any disclaimer, the term of this patent is extended or adjusted under 35 U.S.C. 154(b) by 818 days.

(21) Appl. No.: 11/624,762

(22) Filed: Jan. 19, 2007

(65) Prior Publication Data

US 2008/0029658 A1 Feb. 7, 2008

Related U.S. Application Data

(60) Provisional application No. 60/743,205, filed on Feb. 1, 2006.

(51) Int. Cl.
*B65D 33/00* (2006.01)

(52) U.S. Cl. ..... 383/33; 141/114; 141/316; 141/337; 141/391; 248/95; 248/907; 53/390

(58) Field of Classification Search ..... 248/94, 248/95, 99, 150, 907; 53/390; 383/33; 141/10, 141/114, 313, 316, 331, 337, 340, 390, 391; 220/908.3

See application file for complete search history.

(56) References Cited

U.S. PATENT DOCUMENTS

| | | | | |
|---|---|---|---|---|
| 176,555 | A | | 4/1876 | Scholfield |
| 4,037,778 | A | | 7/1977 | Boyle |
| 4,268,081 | A | | 5/1981 | Hawkinson |
| 4,273,167 | A | | 6/1981 | Stillwell |
| D308,270 | S | | 5/1990 | Sarabia |
| D309,966 | S | | 8/1990 | Bishop |
| 5,031,277 | A | | 7/1991 | Coker |
| 5,048,778 | A | | 9/1991 | Wright |
| 5,163,278 | A | | 11/1992 | Martenhoff et al. |
| D334,448 | S | | 3/1993 | Fish |
| 5,271,589 | A | * | 12/1993 | Belous ..... 248/97 |
| D361,185 | S | * | 8/1995 | Seiler et al. ..... D34/5 |
| 5,593,117 | A | | 1/1997 | Alexander, III |
| 5,765,614 | A | | 6/1998 | Kardosh |
| 5,868,364 | A | | 2/1999 | MacMillan |
| 5,871,037 | A | | 2/1999 | Feldt |
| 5,915,768 | A | | 6/1999 | Young |
| 6,007,030 | A | | 12/1999 | Judge |
| 6,085,647 | A | | 7/2000 | Burow |
| 6,116,548 | A | | 9/2000 | Oleson |
| 6,131,759 | A | | 10/2000 | Young |

(Continued)

OTHER PUBLICATIONS

"Lawn Funnel for Paper Bags", http://housewares.hardwarestore.com/35-179-trash-and-yard-bags/lawn-funnel-for-paper-bags-607899.aspx".

(Continued)

*Primary Examiner*—Gregory L Huson
*Assistant Examiner*—Jason K Niesz
(74) *Attorney, Agent, or Firm*—Barlow, Josephs & Holmes, Ltd.

(57) ABSTRACT

An article to aid loading a leaf bag is disclosed. The article has a tubular body member configured and arranged to fold substantially flat and insert into a leaf bag and a funnel structure extending from the tubular body member, which is also configured and arranged to fold substantially flat. The funnel structure comprises at least one panel connected to at least one flexible insert to form a substantially cone-shaped funnel that empties into the tubular body member.

14 Claims, 6 Drawing Sheets

U.S. PATENT DOCUMENTS

| | | | |
|---|---|---|---|
| 6,135,518 | A | 10/2000 | Holthaus |
| 6,155,522 | A | 12/2000 | Anderson |
| 6,293,505 | B1 | 9/2001 | Fan |
| 6,415,713 | B1 | 7/2002 | Abrams |
| 6,708,742 | B2 | 3/2004 | Weathers et al. |
| 6,938,860 | B2 | 9/2005 | Singleton |
| D513,352 | S | 12/2005 | Weathers et al. |
| 6,983,965 | B1 | 1/2006 | Bergell |
| 2004/0026578 | A1 | 2/2004 | King et al. |
| 2006/0032991 | A1 | 2/2006 | Gaines |
| 2006/0144467 | A1 | 7/2006 | Butzer et al. |

OTHER PUBLICATIONS

"Lawn Funnel for Paper Bags", http://www.homeandbeyond.com/prod-0080815.html.

"Trash Funnel", http://www.choiceproductsinc.com/trash/funnel.html.

* cited by examiner

LEAF BAG FUNNEL

CROSS-REFERENCE TO RELATED APPLICATION

This application claims priority to earlier filed U.S. Provisional Patent Application Ser. No. 60/743,205, filed Feb. 1, 2006, the contents of which are incorporated herein by reference.

BACKGROUND OF THE INVENTION

1. Field of the Invention

The present invention relates generally to yard maintenance tools and more particularly to a leaf bag funnel used for collecting fallen leaves and yard debris into leaf bags.

2. Background of the Related Art

Communities that have a dump site or service for collecting and disposing of leaves, yard debris and other organic waste often require that the debris be collected in biodegradable paper bags. An example of a prior art leaf bag is shown generally at 10 in FIG. 1. These leaf bags frequently have dimensions of 35" high by 15½" wide by 11½" deep and resemble an oversized paper grocery bag. Home owners rake their lawns and deposit the collected leaves and yard waste into the leaf bags for later pickup by the community disposal service. The home owner may also deliver the filled leaf bags themselves to a dump site too.

These prior art bags, however, suffer from the disadvantage in that they are difficult to load by a lone individual. In particular, these leaf bags tend to fold-up on themselves causing them to fall down and not stand upright if a second person is not available to firmly hold and support the leaf bag while another loads the leaf bag.

Additionally, the opening at the top tends to also fold closed making it difficult and irritating to load the leaf bag. Even if the top opening of the leaf bag remains fully open, as when being held by another person, the opening itself is not very large. Because the opening itself is not very large, leaves and debris will often spill over the edge of the leaf bag and onto the yard during loading. This problem makes loading leaf bags a time consuming and irritating process if an individual does not have help with the process.

Because leaf bags are manufactured of paper, these prior art leaf bags also suffer from the disadvantage of being easily torn during loading. This situation results not only in a wasted leaf bag, but also the user must reload the yard debris already collected into yet another leaf bag.

Therefore, there is a need for a device to support a leaf bag that minimizes the chances of tearing the leaf bag and minimizes the frequency of spilling leaves and yard debris back onto the lawn. Moreover, there is a need for a device that allows an individual to load the leaf bag without the assistance of another individual.

SUMMARY OF THE INVENTION

The present invention solves the problems of the prior art by providing a leaf bag funnel that includes a folding tubular body member with a unique folding funnel top. In particular, the tubular body member has four interconnected body panels. Four funnel panels extend upwardly from the four interconnected body panels, respectively. Four flexible inserts interconnect each of the four funnel panels together to form a funnel structure that empties into the tubular body member.

Accordingly, among the objects of the present invention is the provision for a leaf bag funnel that is collapsible.

Another object of the present invention is the provision for a leaf bag funnel that includes a folding funnel structure.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
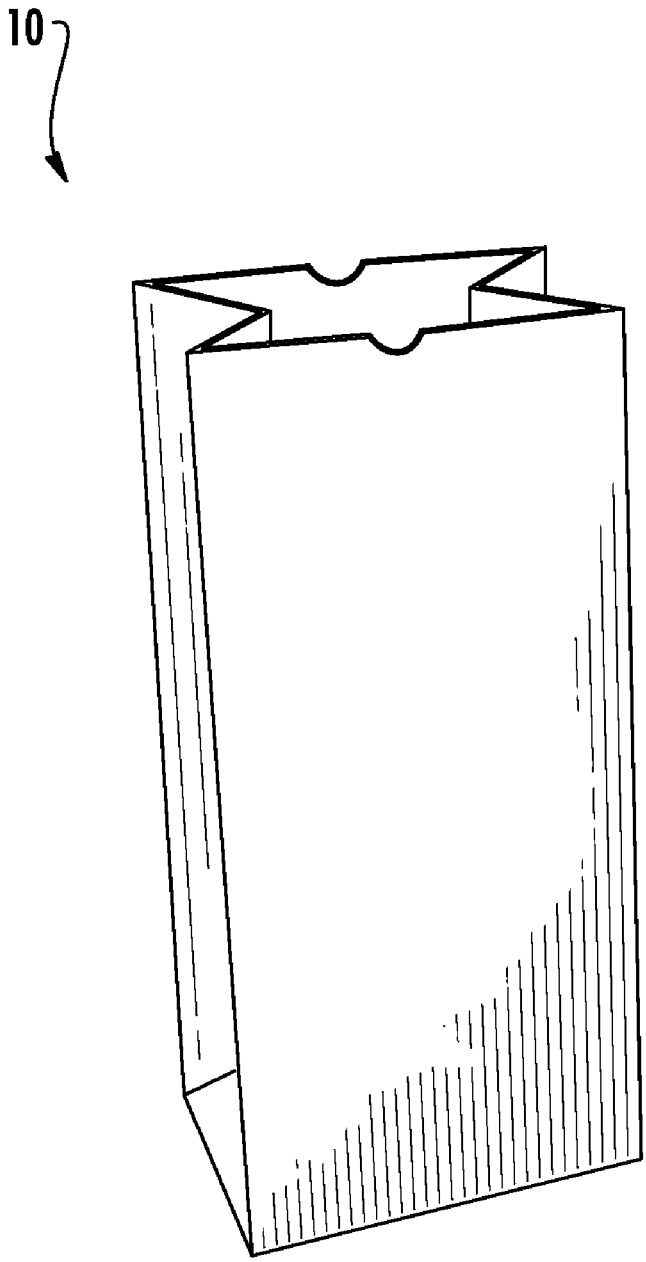
FIG. 1 (PRIOR ART)
FIG. 1 is a perspective view of a prior art paper leaf bag.
Figure 2:
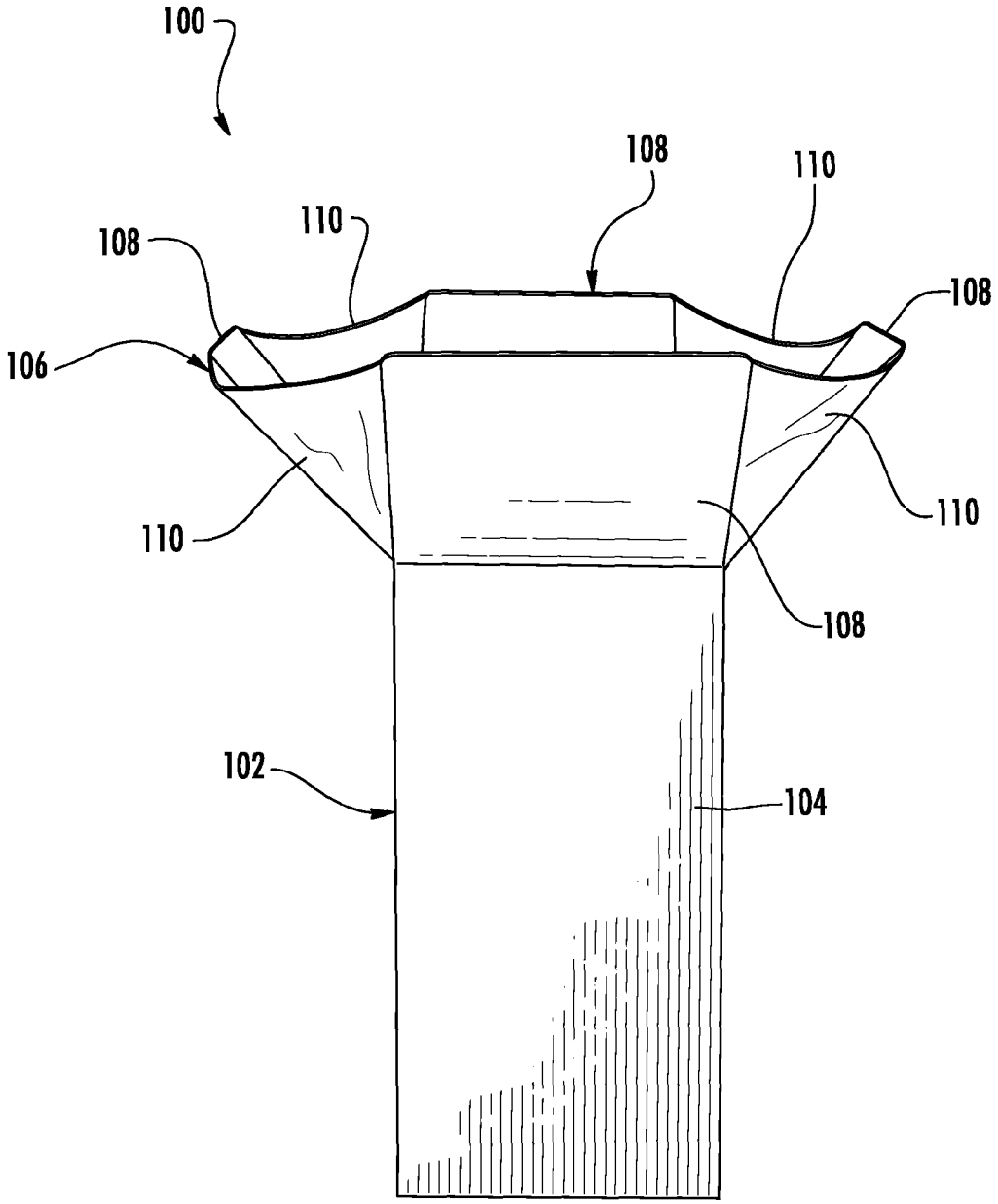
FIG. 2 is an elevation view of the preferred embodiment of the present invention adjacent.
Figure 3:
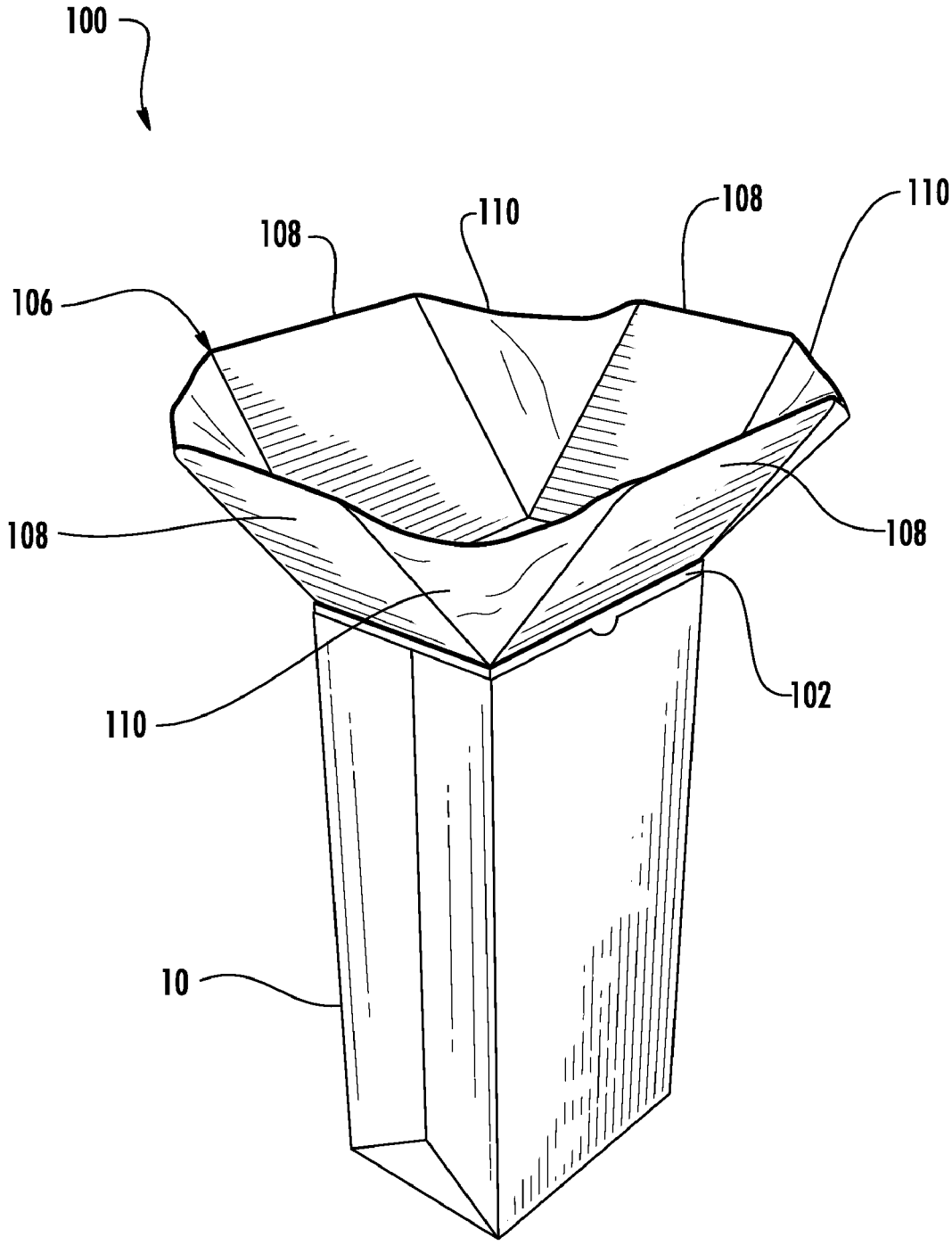
FIG. 3 is a perspective view of the preferred embodiment of the present invention inserted into a prior art leaf bag.
Figure 4:
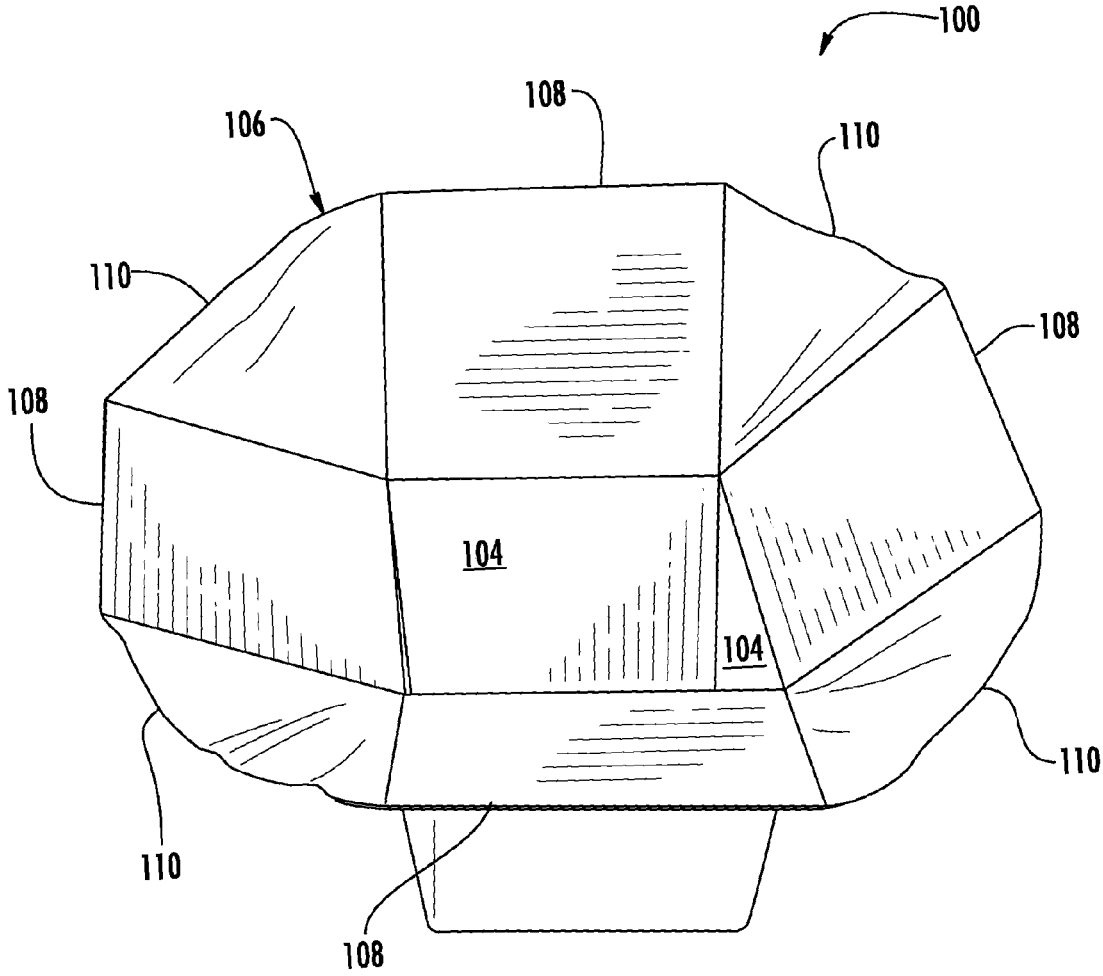
FIG. 4 is a top perspective view of the preferred embodiment of the present invention.
Figure 5:
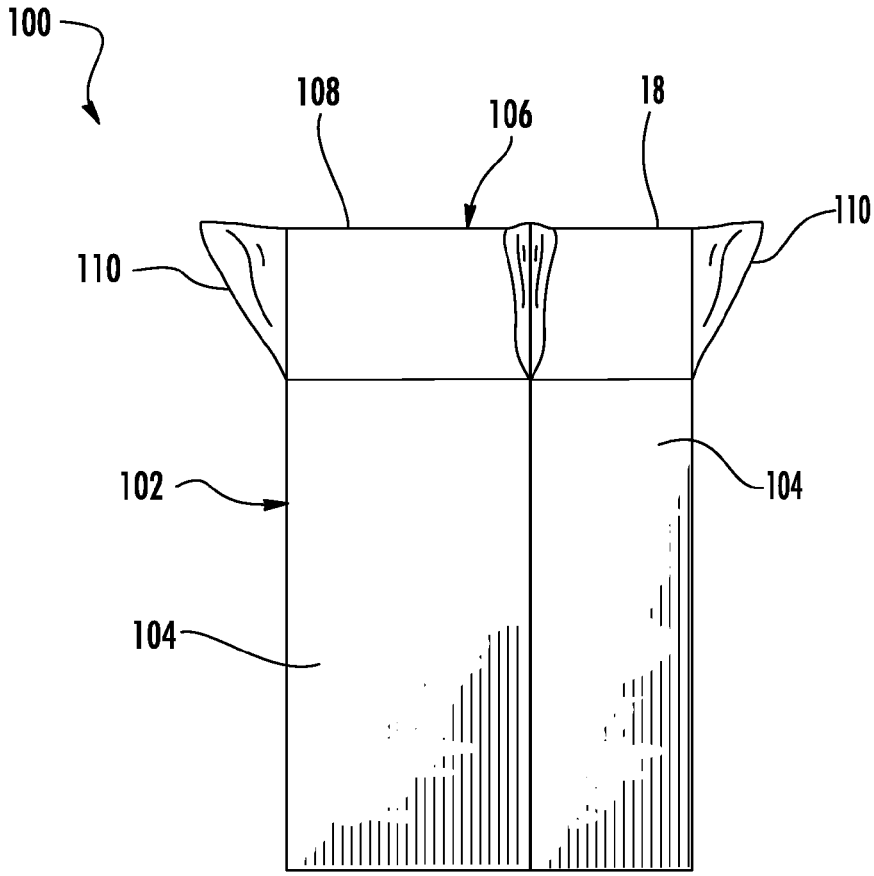
FIG. 5 is a side view of the preferred embodiment of the present invention collapsed nearly flat.
Figure 6:
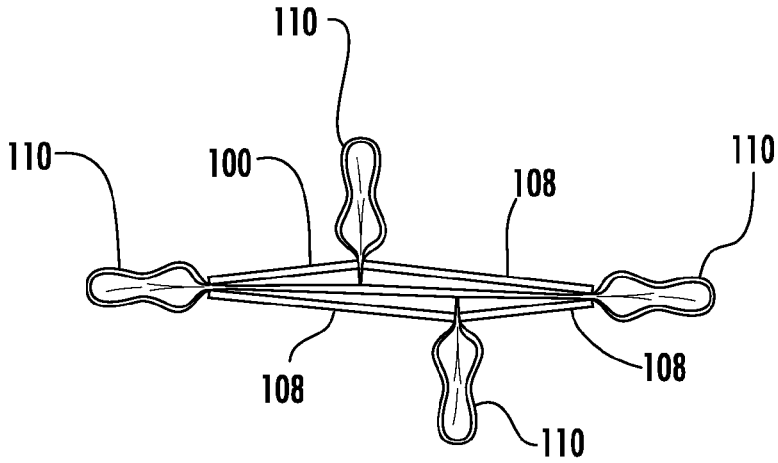
FIG. 6 is a top view of the preferred embodiment of the present invention collapsed nearly flat.
Figure 7:
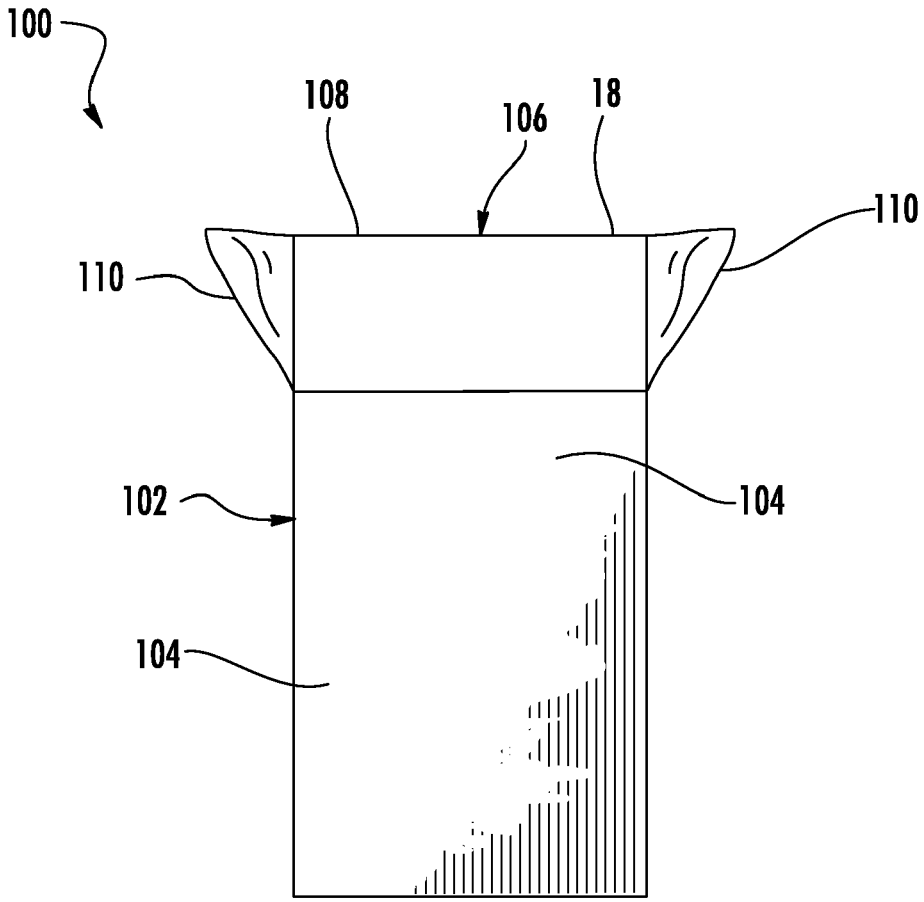
FIG. 7 is a side view of an alternative folding arrangement for the leaf bag funnel of the present invention.
Figure 8:
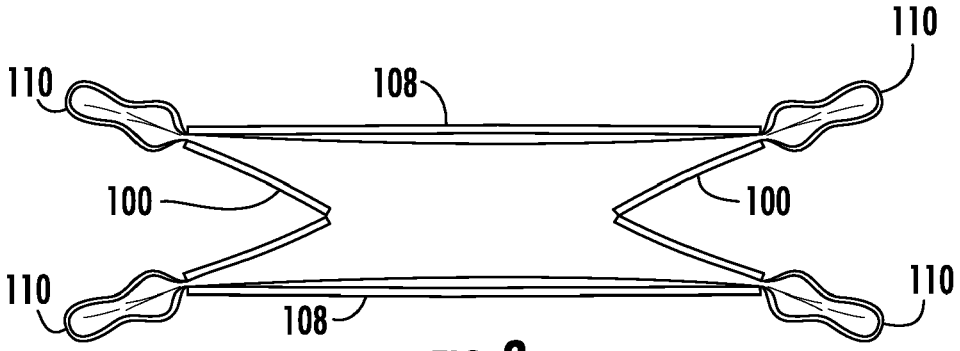
FIG. 8 is a top view of the alternative folding arrangement shown in FIG. 7.

Referring to FIGS. 2-4, the leaf bag funnel is shown generally at 100. As can be seen, the leaf bag funnel includes a tubular body member 102 that is configured and arranged to be inserted into a leaf bag 10. The tubular body member 102 has four sides 104 and may be constructed of a corrugated plastic material. A corrugated plastic material is preferred because it has long-life and is rigid, yet light. The tubular body member 102 may be folded flat, as shown in FIGS. 5 and 6, so that the leaf bag funnel 100 of the present invention may be conveniently stored when not in use. An alternative folding arrangement is shown in FIGS. 7 and 8. Although corrugated plastic is preferable because of these qualities, a variety of other materials may be used as desired, such as cardboard, for instance.

Extending from a top end of the leaf bag funnel is a funnel structure 106. The funnel structure 106 is formed from four panels 108 extending from the four 104 sides of the tubular body member 102 that are connected together edge-to-edge with flexible inserts 110 to from a continuous funnel surface. Referring to FIG. 3, each of the flexible inserts 110 has a triangular shape and is adhered with hot glue to two adjacent panels of the four panels 108. Because the flexible inserts 110 are triangular, the funnel structure 106 has an octagonal bowl shape. Although hot glue is preferred, any adhesive or other fasteners may be used. The flexible inserts 110 are preferably made of vinyl, although other materials could be used. Whichever material is used for the flexible inserts, it must be flexible or the tubular body member will not be able to fold away for later storage.

To use the leaf bag funnel 100 of the present invention, a user inserts the tubular body member 102 of the leaf bag funnel 100 into the leaf bag 10 as shown in FIG. 3. The user then loads leaves and yard debris into the funnel structure 106 of the leaf bag funnel 100. Because the funnel structure 106 has a bowl shape, the leaves and yard debris fall into the tubular body member 102 and collect in the bottom of the leaf bag 10. To remove the leaf bag funnel 100 from the leaf bag 10, the user simply pulls upwards on the funnel structure 106 with one hand while holding onto the leaf bag 10 with the other hand. The tubular body member 102 separates from the leaf bag 10 and leaves the leaves and yard debris within the leaf bag 10. The user can then close and dispose of the leaf bag 10.

Therefore, it can be seen that the present invention provides a unique solution to the problem of providing a device that allows an individual to load a leaf bag without assistance. Additionally, the leaf bag funnel of the present invention prevents the leaf bag from collapsing and minimizes the risk of the user tearing the leaf bag. The leaf bag funnel also helps prevent the user from spilling leaves and yard debris back onto the yard while loading the leaf bag.

It would be appreciated by those skilled in the art that various changes and modifications can be made to the illustrated embodiments without departing from the spirit of the present invention. All such modifications and changes are intended to be within the scope of the present invention except as limited by the appended claims.

What is claimed is:

1. An article to aid loading a leaf bag, comprising:

a tubular body member configured and arranged to insert into a leaf bag and to fold substantially flat; and an funnel structure extending upwards from and integrally connected to said tubular body member and configured and arranged to fold substantially flat, said funnel structure comprising at least one panel connected to at least one flexible insert to form substantially cone-shaped funnel emptying into said tubular body member.

2. The article of claim 1, wherein there are four panels interconnected to four flexible inserts to form said funnel structure.

3. The article of claim 1, wherein said at least one flexible insert is constructed from a vinyl sheet material.

4. The article of claim 1, wherein said tubular body member and said at least one panel are constructed from a corrugated plastic material.

5. The article of claim 1, wherein said at least on flexible insert is substantially triangular in shape.

6. The article of claim 1, wherein said tubular body member is sized and dimensioned to fit into a paper leaf bag having dimensions about 35" high by about 15½" wide by about 11½" deep.

7. An article to aid loading a leaf bag, comprising:

a tubular body member having four interconnected body panels sized and dimensioned to fit into a leaf bag;

four funnel panels extending upwards from and integrally connected to said four interconnected body panels, respectively; and four flexible inserts interconnecting each of said four funnel panels together edge-to-edge to form a funnel structure emptying into said tubular body member;

said tubular body member and said funnel structure configured and arranged to fold substantially flat.

8. The article of claim 7, wherein said flexible inserts are constructed from a vinyl sheet material.

9. The article of claim 7, wherein said tubular body member and said funnel panels are constructed from a corrugated plastic material.

10. The article of claim 7, wherein said flexible inserts are substantially triangular in shape.

11. The article of claim 7, wherein said tubular body member is sized and dimensioned to fit into a paper leaf bag having dimensions about 35" high by about 15½" wide by about 11½" deep.

12. An article to aid loading a leaf bag, comprising:

a tubular body member having four rigid interconnected body panels sized and dimensioned to fit into a leaf bag having dimensions about 35" high by about 15½" wide by about 11½" deep;

four rigid funnel panels extending upwards from and integrally connected to said four interconnected body panels, respectively; and four flexible inserts having a substantially triangular shape interconnecting each of said four funnel panels together edge-to-edge to form a funnel structure emptying into said tubular body member;

said tubular body member and said funnel structure configured and arranged to fold substantially flat.

13. The article of claim 12, wherein said flexible inserts are constructed from a vinyl sheet material.

14. The article of claim 12, wherein said tubular body member and said funnel panels are constructed from a corrugated plastic material.

* * * * *